United States Patent [19]

Miselli

[11] Patent Number: 4,875,329

[45] Date of Patent: Oct. 24, 1989

[54] WRAPPING MACHINE, PARTICULARLY FOR BLISTER PACKS AND THE LIKE, WITH SYNCHRONIZED PLURAL DRIVING MEANS

[75] Inventor: Carlo A. Miselli, Castel San Pietro Terme, Italy

[73] Assignee: I.M.A. - Industrie Macchine Automatiche S.p.A., Ozzano Emilia, Italy

[21] Appl. No.: 116,485

[22] Filed: Nov. 2, 1987

[30] Foreign Application Priority Data

Dec. 29, 1986 [IT] Italy ..... 3625 A/86

[51] Int. Cl.[4] ..... B65B 11/50; B65B 57/00

[52] U.S. Cl. ..... 53/559; 53/77; 53/167

[58] Field of Search ..... 53/77, 167, 560, 559, 53/454, 453

[56] References Cited

U.S. PATENT DOCUMENTS

| | | | |
|---|---|---|---|
| 4,172,347 | 10/1979 | Nitz | 53/77 X |
| 4,233,801 | 11/1980 | Watt | 53/453 |
| 4,506,488 | 3/1985 | Matt et al. | 53/77 X |
| 4,525,977 | 7/1985 | Matt | 53/77 X |

*Primary Examiner*—James F. Coan

*Attorney, Agent, or Firm*—Herbert Dubno

[57] ABSTRACT

A wrapping machine for making blister packs has two machine sections for the formation of a continuous strip of blister packs by means of a stamping operation on a thermoplastic tape and for the separation of the individual blisters from the strip for the packaging thereof. Each of the machine sections is provided with its own drive which is phase-synchronized with the pilot motor of the downstream machine section effecting the separation of the individual blister packs from the continuous strip of blister packs and their packaging and the motors controlled by the stamping elements of the upstream machine section which forms the continuous blister pack strip.

5 Claims, 6 Drawing Sheets

WRAPPING MACHINE, PARTICULARLY FOR BLISTER PACKS AND THE LIKE, WITH SYNCHRONIZED PLURAL DRIVING MEANS

FIELD OF THE INVENTION

The present invention relates to a wrapping machine, and more particularly to a machine for making blister packs and the like with synchronised plural driving means.

BACKGROUND OF THE INVENTION

It is known that in wrapping machines, particularly in automatic machines of the cyclical type, which have very complex structures and operations, the single finished product discharged by such a machine is the result of numerous and complex operations carried out by a variety of elements (feeding means for the wrapping material and for the product to be wrapped, transport means, sectioning means, etc.).

Each of these elements has a specific operational cycle and deriving its movement (continuous, intermittent, alternating, etc.,) from a common source, consisting, for example, of a continuously driven rotating shaft, operated directly or through mechanical connection means by the drive motor of the machine.

These operations are obviously carried out according to a well-defined sequence and as a function of the precise and constant relationships between the operating cycles of the elements. The accurate timing of these phase relationships guarantees, in addition to a proper functioning of the machine, the output of faultless finished products. These phase relationships are, as a rule, depicted within the totality of the by graphs representing the laws of motion of each of the cyclically operating elements, sketched with respect to a common reference, in particular as a function of the angular position, measured in degrees from a predetermined "null position" of the said continuously rotating shaft which is normally referred to as the "cycle shaft" while the term "machine cycle" or cycle alone refers to one rotation of said shaft through 360° from the aforesaid "null position".

These machines make extensive use of elements which are being associated with control and detector means of various types and are intended to intervene in the the production process either sporadically or periodically, but at a much lower frequency relative to the previously mentioned elements. Among these there may be mentioned for example the devices provided for periodically replacing the roll of packaging material as it is being exhausted, the devices for rejecting incomplete or poorly completed products, etc.

As a consequence, as these last-mentioned elements are usually at rest, their actions are effected by means of independent motors or are derived from the driving means of the machine only when so commanded by the said control or detector means, which intervention has to take place in consideration of the precise phase relationship appropriate to the laws which govern the intervention of the cyclically operating elements, as mentioned previously. To illustrate this, I mention the case of an ejector which, having to eject a defective product from an intermittently moving transport means, has to wait until the latter is at rest.

Furthermore, as is known, the phase coordination between the elements which intervene normally in the various productive operations and the intermittently operating elements is obtained by means of the "cycle shaft" and, more specifically, concurrently with the actuation of the last mentioned means, the functioning of which is already dependent on the operation of the control and detector means the coordination is effected, in relation to the given phase, by means linked with this cycle shaft electromechanically or, in the case of complex high-speed production machines, electronically.

Referring now particularly to the blister-pack producing wrapping machines which are known, the blisters are obtained in a continuous strip, by conveying along the operating track of the machine a strip of thermoplastic material unrolling from a roll and subjected to a series of successive operations along the operating track at the corresponding work stations of the wrapping machine.

Thus, for example, in a well-known blister-pack producing machine, manufactured and sold by the assignee of this application under the Trade Mark IMA C 60, the strip of thermoplastic material is substantially first subjected to a differential heating and then to the action of pressing means to stamp into the strip thus preheated lodgings or cells (blisters) for containing the individual products to be wrapped. The blister-carrying strip thus constituted, in its movement along the operating line of the wrapping machine, passes through a feeder station for the products to be wrapped, which products are lodged one by one successively into said cells and, subsequently. through a station for closure by hermetical sealing of the said blisters, each of which contains one of the products to be wrapped.

The sealing is effected by the superposition on said strip of thermoplastic material thus formed and thus filled with the products to be wrapped, a second strip, usually made of aluminum, weldable to the first strip of thermoplastic material, obtaining in this manner the aforesaid continuous strip of blister packs.

Finally, the continuous trip of blister packs thus obtained is either fed to a further machine for subsequent treatments prior to the separating and packaging operations or is caused to pass through a separating station of the same machine where, by sectioning, the individual blisters are separated rhythmically and successively. The blisters are stacked for introduction, at the end of the production cycle, into container cases or are fed in succession to another packaging machine.

The advancing movement of the strip along the operating line of this wrapping machine IMA C 60 is effected in a continuous mode up to the hermetically sealing closure section where the blisters are sealed by means of one or more drawing rollers disposed correspondingly to said closure station so as to operate from a counter-roller a thermal welding roller to effect the hermetically thermal welding of the two superimposed strips, and in intermittent mode or by successive passes in the predetermined case of its immediate separation into individual successive blisters between these two respective stations of closure and separation.

These machines for making blister, having an integrated operating line and operating with continuous movement in the machine section dedicated to the preparation of a continuous strip of blister packs and with intermittent movement in the machine section effecting the separation of the individual blister packs from the said continuous strip and for the packaging of said individual blister-packs singly or in groups in boxes or cases, derive these movements from a single common source, that is to say a single, continuously rotating shaft, called "cycle shaft".

Such machines yield optimum results from the point of view of product quality and productivity per unit of time, and at high speed. They are referred to in the trade jargon as rigid machines because of the common source of the two movements, continuous and intermittent, of the two machine sections, and also because in order to vary the dimensions of the finished product it is necessary to change the so-called "shaping" elements or pieces of the machine.

OBJECT OF THE INVENTION

It is the object of the invention to provide a wrapping machine for making up blister packs of this known type having an improved operational flexibility without substantially changing the size and capacity, and which can operate at an improved production rate per unit of time, while being universal with regard to variations in product dimensions.

SUMMARY OF THE INVENTION

This object is attained, according to the invention for the two distinct machine sections of the above-named type, in that the upstream machine section, with continuous movement for the formation of the continuous strip of blister packs, and the downstream machine section, with intermittent movement for the separation from the continuous strip of the individual blisters and the packaging of the latter in boxes or cases, are caused to invert their movement specifically at the station where the blisters are formed by stamping in the continuous strip of thermoplastic material, of the corresponding machine section, by providing it with its own driving means, as well as adopting the conventional solution which provides for a common driving means traditionally employed, providing for a plural synchronized drive, and operating further on the mechanical structure of these two machine sections.

More particularly, the motor serving to drive the downstream machine section for separating from the continuous strip the individual blister packs and for packing the latter into boxes and cases will be referred to as the "lead drive." The motor which drives the elements of the stamping station of the intermittently moving upstream section is referred to as the follower drive. The motors are linked to respective actuating apparatuses. The first motor is provided with a device (a potentiometer) to determine the speed of said main drive, and is associated with a coding device generating incremental pulses (encoder) which acts on a device for converting the frequency of the respective incremental pulses into an analog signal proportional to the speed of the lead drive. The analog signal is applied to a comparator. The second motor, which is associated with the follower drive, is similarly provided with an encoder connected to the comparator, the outputs of said converter and comparator controlling the actuating apparatus of the follower drive.

The upstream machine section involved in intermittent movement has its press parts for stamping out the lodgings (blisters) of the strip of thermoplastic material underneath the unit feeding in the products to be conditioned in said blisters, creating upstream and downstream of the stamping portion, respectively, loops and bends in the strip, constantly controlled by controlling devices in a manner independent of the synchronization between the two motors. The downstream machine section operating with continuous movement effecting the separation from the continuous strip of the individual blister packs and the packing of the latter in boxes or cases, enables that the separation and the transport of the individual blister packs to be effected in multiple parallel rows terminating in their introduction in boxes or cases.

The blister pack forming machine of the invention comprises a blister-forming stamping station for a first continuous strip of thermoplastic material, a feeder station for the products to be enclosed in the blisters, a station for effecting the closure and hermetically sealing of the products in the blisters by the superposition of a second continuous strip on said first strip of thermoplastic material thus shaped and thus fed with the the said products to be packaged, a station for separating the individual blister packs thus obtained and stacking them in desired numbers, a station for associating therewith an element indicating the condition of the individual or stacked blister packs, and a station for packing the blisters or blister stacks in boxes or cases in association with the element indicating the condition of the product. According to the invention the stamping station is located underneath the feeder station and its stamping elements are actuated by a follower motor controlled by a lead motor which actuates the elements of the other stations the motors being acted upon by respective actuator devices of which the one controlling the lead motor is in turn controlled by a device for determining the desired speed of the lead motor.

The lead and follower motors are associated with corresponding coding devices generating incremental impulses (encoders). The first encoder, that which is associated with the lead motor, feeds a device for converting the frequency of the respective incremental pulses into an analog signal proportional to the speed of the lead motor and a comparator device. The second encoder, which is associated with the follower motor, feeds a signal to the same comparator device. The outputs of the converter and comparator control the actuating device of the aforesaid follower motor.

The said separator and stacking stations also carry out the transport operation in multiple parallel rows to the station associating the products with the element indicating the condition of the products and hence to the station for packing same into boxes or cases.

BRIEF DESCRIPTION OF THE DRAWING

Further features and advantages of the wrapping machine according to the present invention will be clearly apparent from the following detailed description, reference being made to the attached drawing, in which.

SUMMARY OF THE INVENTION

Figure 1A:
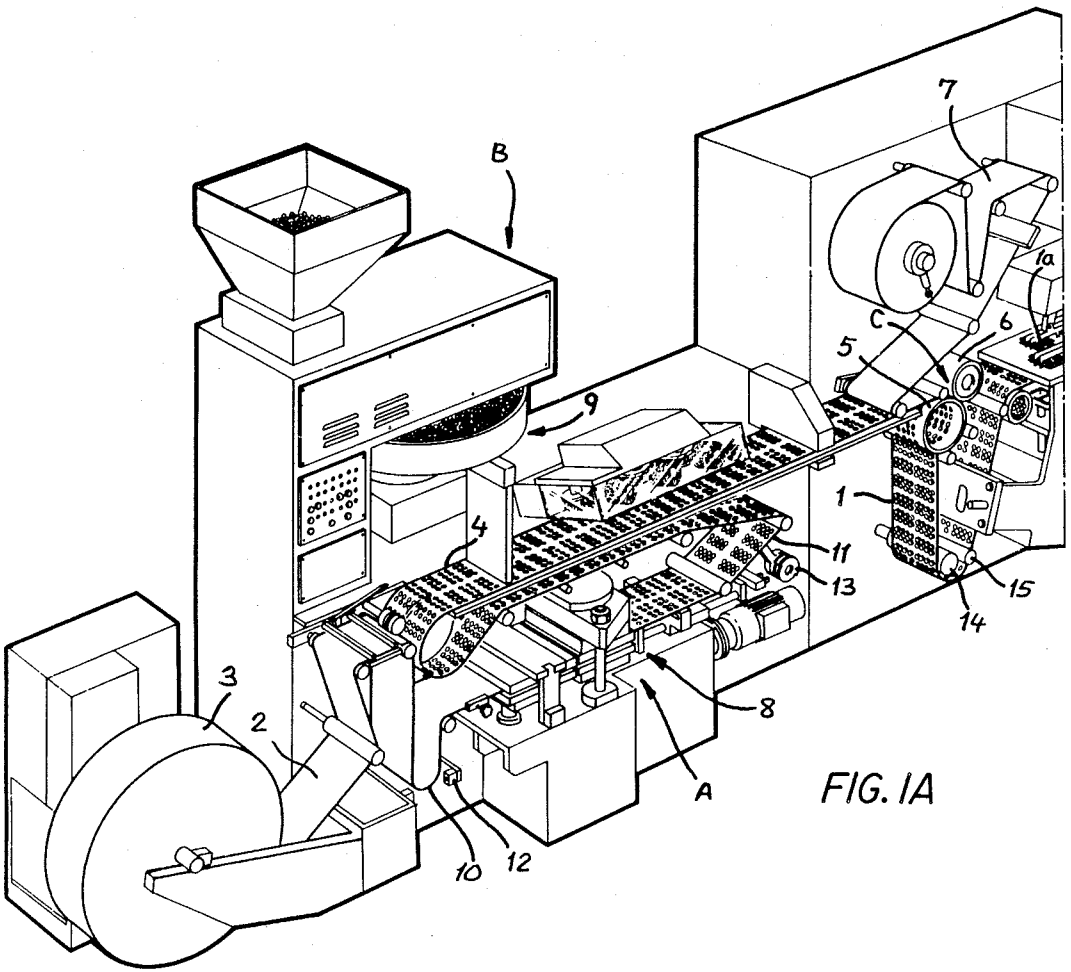
FIGS. 1A and 1B are a schematic perspective front-side elevation of the operating line of the said machine according to the invention with FIG. 1A showing the left side thereof and FIG. 1B showing the right side thereof.
Figure 1B:
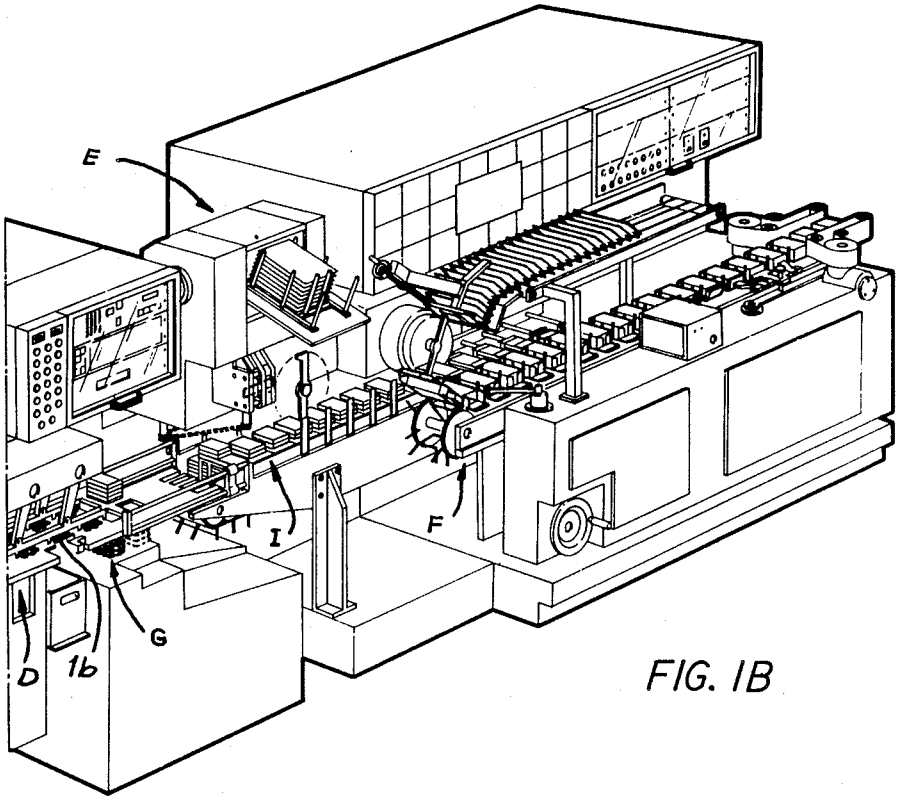
Figure 2A:
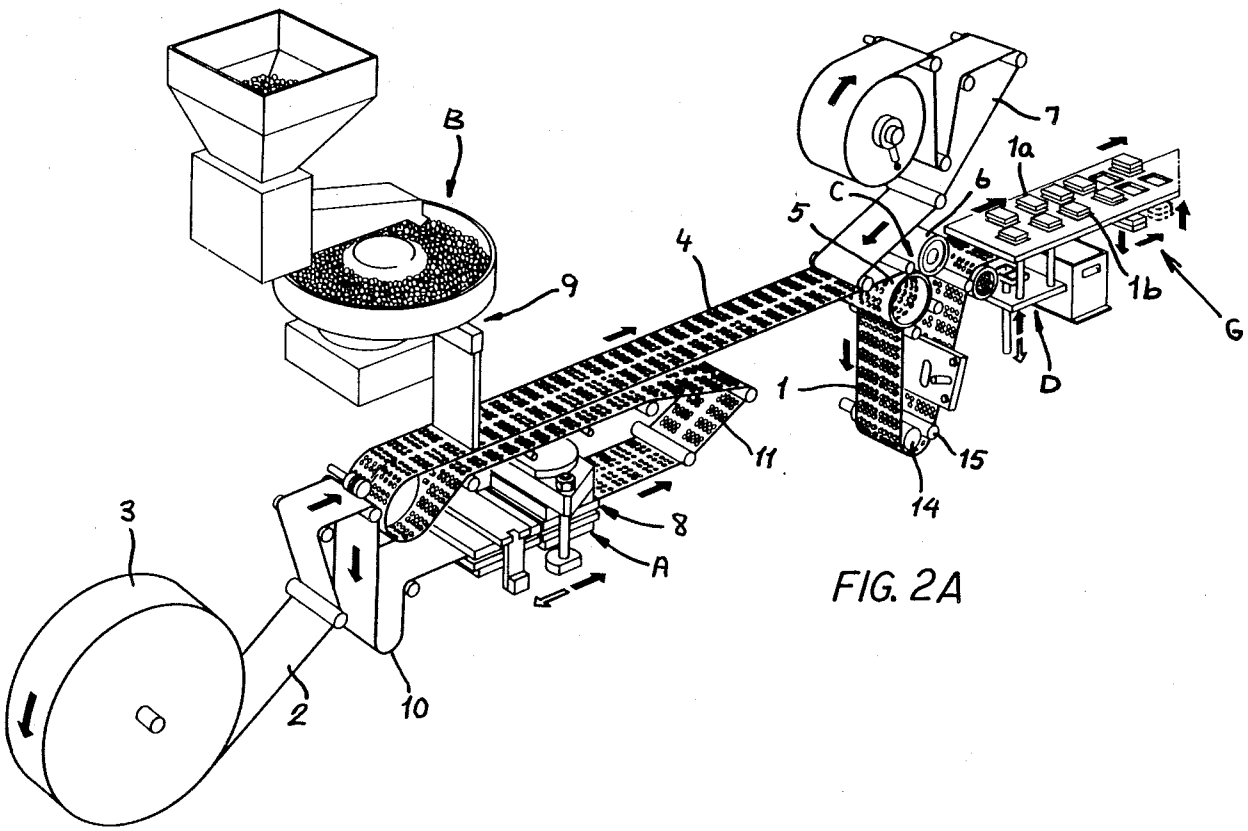
FIGS. 2A and 2B are a schematic perspective front-side elevation view of the operating line of the said machine according to the invention with parts removed and FIG. 2A illustrating the left hand side and FIG. 2B illustrating the right hand side of the operating line.
Figure 2B:
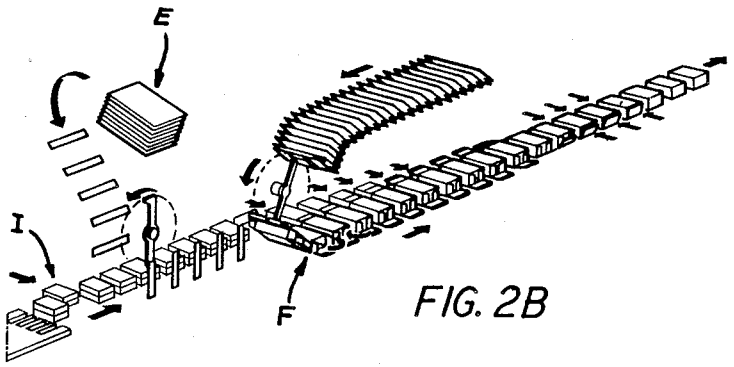
Figure 3:
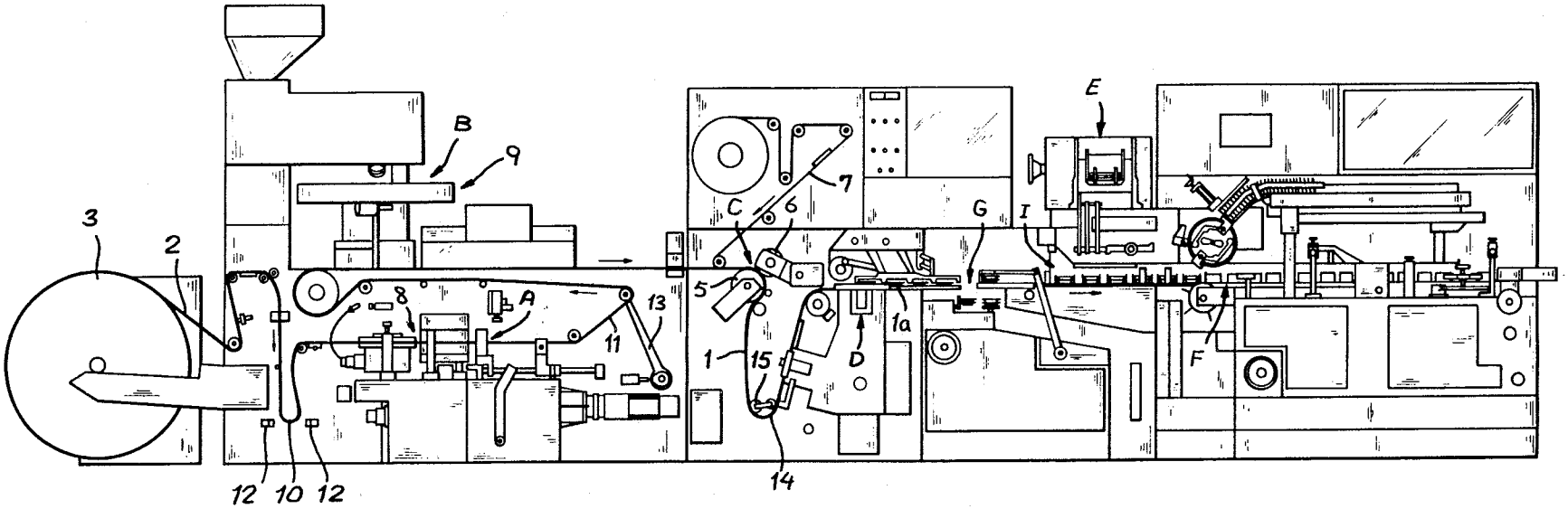
FIG. 3 is a front elevation of the wrapping machine according to the invention.

A continuous strip 1 of blister packs is formed and separated into individual blister packs. The stacking and transport of the individual blister packs for packaging in boxes or cases, is likewise effected in the machine. The continuous strip of blister packs (see FIGS. 1A, 1B, 2A, 2B and 3) is obtained essentially by feeding along the horizontal operating line of the machine a strip 2 of thermoplastic material drawn from a roll 3.

The strip 2 is subjected to a series of operations along the operating line of the machine in accordance with the number of operational stations of the machine.

First the strip is subjected at a station A to the action of stamping means to form, in transversal and longitudinal alignment, by stamping in said strip 2, lodgings (blisters) 4 to contain the individual products to be packed. The strip is drawn by drawing rollers 5, 6 through a station B for feeding into the blisters, the products to be contained therein, then through a station C which effects the closure by hermetical sealing of the said blisters 4, each containing one product to be packed, by the superposition on the strip 2 of thermoplastic material, a second strip 7, usually of aluminum, weldable to the thermoplastic material strip 2, thus obtaining a continuous strip 1 of blister packs.

The continuous strip of blister packs 1 then reaches a station D of the machine, at which location cutting means rhythmically separate the individual blister packs which, optionally stacked in a desired number. arrive, on completion of the operating cycle, at a station F, to be set into containers, having first passed through a station E which has an element detecting the condition of the packed product associated with it.

In the wrapping machine according to the present invention, the stamping means 8 for stamping blisters 4 in the strip of thermoplastic material 2 at station A are arranged underneath the feeder elements 9 of station B, creating, in said strip 2, upstream and downstream of said stamping means 8, respective loops and bends 10, 11 constantly controlled by corresponding control devices 12, 13 and, immediately downstream of said closure station C, it is structured to operate in correspondence with the station D effecting the separation of the strip 1 into individual blister packs and in correspondence with station G for the stacking of said individual blister packs, in the form of multiple parallel rows to the station I where these are aligned in a single file (see the concurrently filed commonly assigned patent application Ser. No. 07/116,484 filed 2 Nov. 1987) in order to pass through the aforementioned stations E and F.

A machine thus constructed according to the present invention is provided with plural synchronized driving means so as to cause the strip 2 to advance through the station A with intermittent movement or successive passes to effect the stamping of blisters 4 by the aforesaid stamping means 8, to advance the strip 2 thus provided with blisters 4 through the station B to feed into said blisters the products to be conditioned and through the station C for closure by sealing said products into said blisters in a continuous movement, forming loops or bends 14 controlled by a control device 15 in a manner independent of the synchronised plural driving means being the object of the present invention, to the station D effecting the division of the continuous strip 1 of blister packs into individual blister packs 1*a*, 1*b* in multiple parallel rows and hence, see the aforesaid patent application, through the aforementioned stations, G for stacking, I for alignment in a single file and the above mentioned conditioning stations E and F.

Figure 4:
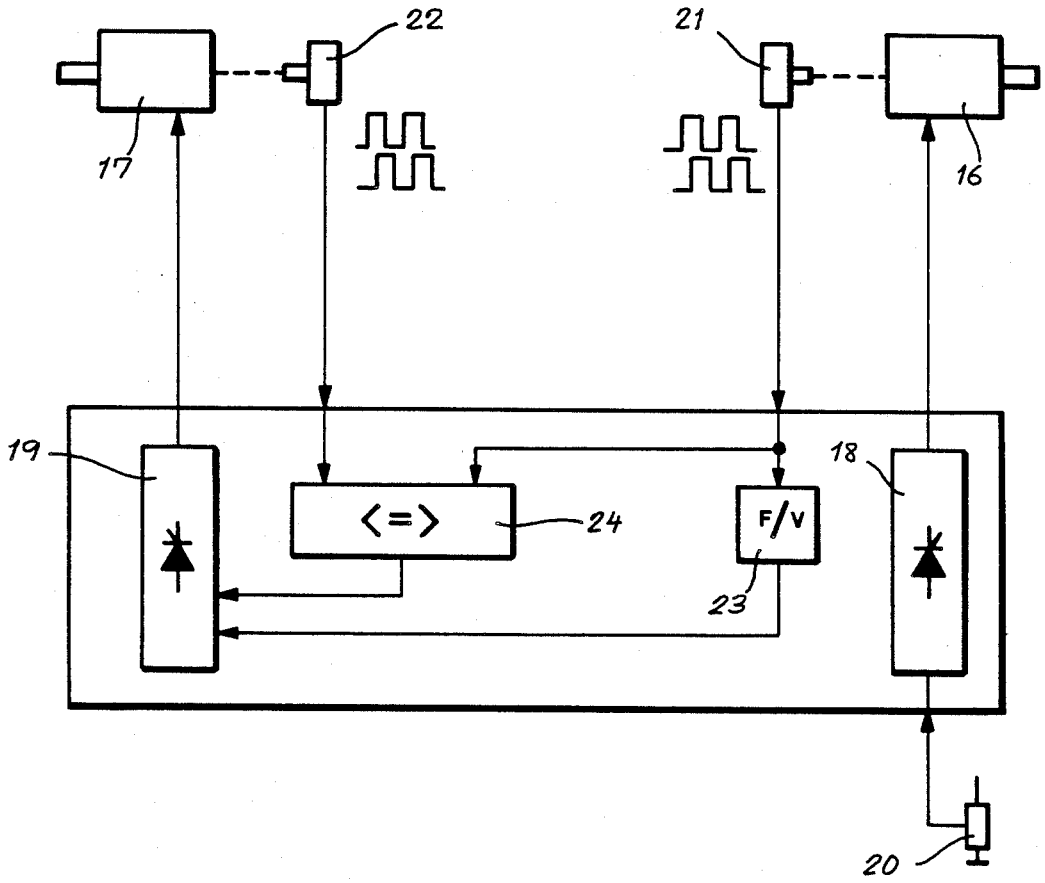
FIG. 4 is a block diagram of the synchronized plural drive system of the wrapping machine according to the invention.

Such a plural synchronised motorization according to the present invention comprises, see FIG. 4, a motor 16, called the leader motor, for driving the downstream machine section for the separation from the continuous strip 1 of the individual blister packs 1*a*, 1*b* and for the packaging of the latter in boxes or cases, and a motor 17, called the follower motor, for driving the elements of the stamping station A of the upstream machine section. The motors 16 and 17 are subject to the action of respective actuator means actuator 18 and 19, of which the one, 18, acting on the leader motor 16, is in turn acted upon by a device 20 (potentiometer) for determining the desired speed of this leader motor 16.

With the leader motor 16 and follower motor 17, there is associated a respective corresponding coding device 21, 22 generating incremental pulses (encoder) of which the first encoder 21, acted on by the leader motor 16, controls a device 23 for converting the frequency of the respective incremental pulses into an analog signal proportional to the leader motor 16 and a comparator device 24, and the second encoder 22 and associated with the follower motor 17, acts on the same comparator device 24. The outputs of the said converter 23 and comparator 24 devices further control the actuator device 19 of the aforesaid follower motor 17.

I claim:

1. A machine for producing and packaging blister packs, comprising:

means defining a transport path and having a first motor operatively connected for intermittent operations along an upstream segment of said path and a second motor operatively connected for continuous operations along a downstream segment of said path;

stamping means along said upstream segment for stamping blisters from a continuous thermoplastic strip intermittently advance by drive of said first motor along said path;

a station for feeding products to be packed into said blisters at a location downstream of said stamping means along said upstream segment;

sealing means for applying a closure strip to said thermoplastic strip at a location downstream of said station along said path to seal said blisters and form a continuous strip of blister packs from said closure and thermoplastic strips;

separating means downstream of said sealing means along said path driven by said second motor for separating said blister packs from said continuous strip of blister packs at a location along said downstream segment;

packaging means downstream of said separating means along said downstream segment of said path for packaging said blister packs in containers;

a device operatively connected to said second motor for establishing a desired speed of said second motor, whereby said second motor constitutes a leader motor;

a respective encoder connected to each of said motors generating respective incremental pulses representing rotation of the respective motors;

a converter connected to receive the respective pulses of the encoder connected to said second motor for converting a frequency of the received pulses into an analog signal proportional to a speed of the leader motor;

a comparator connected to receive the pulses from both of said encoders, said converter and said comparator having outputs; and a driver connected to said first motor for energizing same so as to constitute said first motor as a follower motor, said outputs being connected to said driver to synchronize said follower motor with said leader motor.

2. The machine defined in claim 1 wherein said stamping means are located below said station.

3. The machine defined in claim 2 wherein means is provided between said separating means and said packaging means along said downstream segment for stacking the blister packs from said continuous strip of blister packs and advancing stacks of said blister packs to said packaging means in a plurality of parallel rows.

4. The machine defined in claim 3 wherein said upstream segment of said transport path is provided upstream of and downstream from said stamping means with loops and bends monitored by respective control means independent of the synchronization of said follower motor with said leader motor.

5. The machine defined in claim 3 wherein said separating means and said means for stacking include means for effecting stepwise advance of said blister packs along said downstream segment of said path.

* * * * *